United States Patent [19]

Kreissl et al.

[11] 4,000,706

[45] Jan. 4, 1977

[54] SKIP STITCH MECHANISM FOR SEWING MACHINES

[75] Inventors: Ernst Kreissl, Karlsruhe; Erwin Vahle, Stutensee; Hans Uhlig, Karlsruhe, all of Germany

[73] Assignee: The Singer Company, Elizabeth, N.J.

[22] Filed: May 6, 1976

[21] Appl. No.: 683,866

[52] U.S. Cl. ..... 112/221

[51] Int. Cl.[2] ..... D05B 55/16

[58] Field of Search ..... 112/221, 220, 158 R, 112/79 A, 237, 79 R

[56] References Cited

UNITED STATES PATENTS

| | | | |
|---|---|---|---|
| 3,559,601 | 2/1971 | Tullman | 112/158 R |
| 3,815,529 | 6/1974 | Adams et al. | 112/221 |
| 3,815,532 | 6/1974 | Weisz et al. | 112/221 |
| 3,872,809 | 3/1975 | Adams et al. | 112/221 |

*Primary Examiner*—H. Hampton Hunter
*Attorney, Agent, or Firm*—Edward L. Bell; Robert E. Smith; Edward P. Schmidt

[57] ABSTRACT

A needle bar reciprocation interrupting device is disclosed in which the interruption is effected by a solenoid at any lateral position of a needle in an arrangement wherein an upper end of the needle bar is swung in an arc with an intermediate portion of the needle bar supported in a ball and socket joint structure to result in lateral positioning of the needle. An unlatching frame is carried by bearings within which the needle bar undergoes endwise reciprocation thereby to move laterally with the needle bar. A solenoid supported on a bracket affixed to the sewing machine frame has its armature connected with a fork extension of the unlatching frame closely adjacent the ball and socket joint structure. When the solenoid is activated the unlatching frame is pivoted to swing a ramp portion thereof into engagement with a needle bar carried latch at the end of upward needle bar travel thereby to separate the needle bar from its endwise reciprocating drive mechanism when its velocity is close to zero.

7 Claims, 7 Drawing Figures

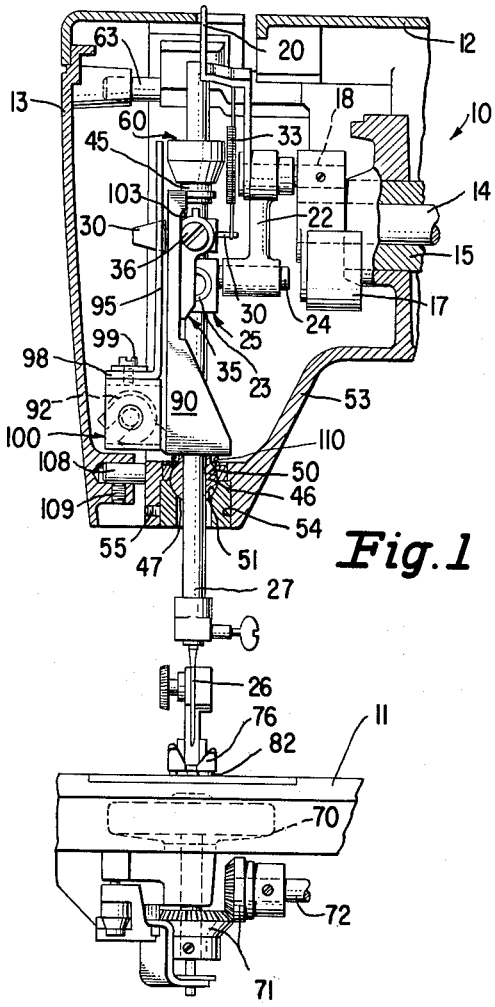
Fig. 1
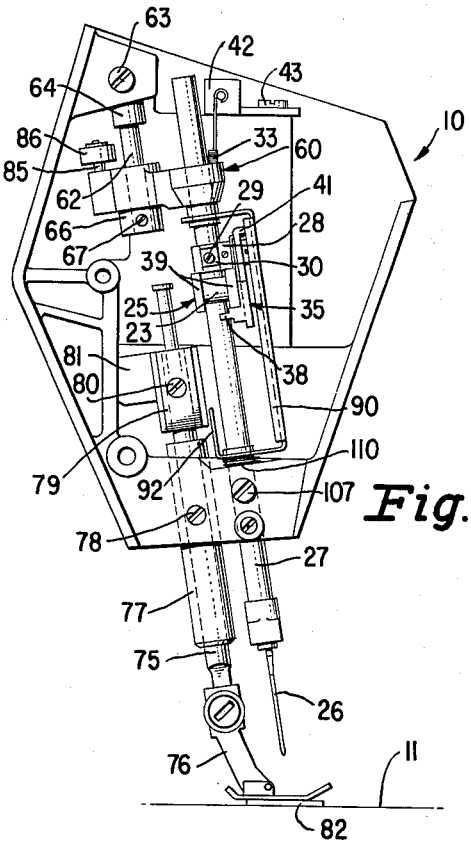
Fig. 2
Fig. 3
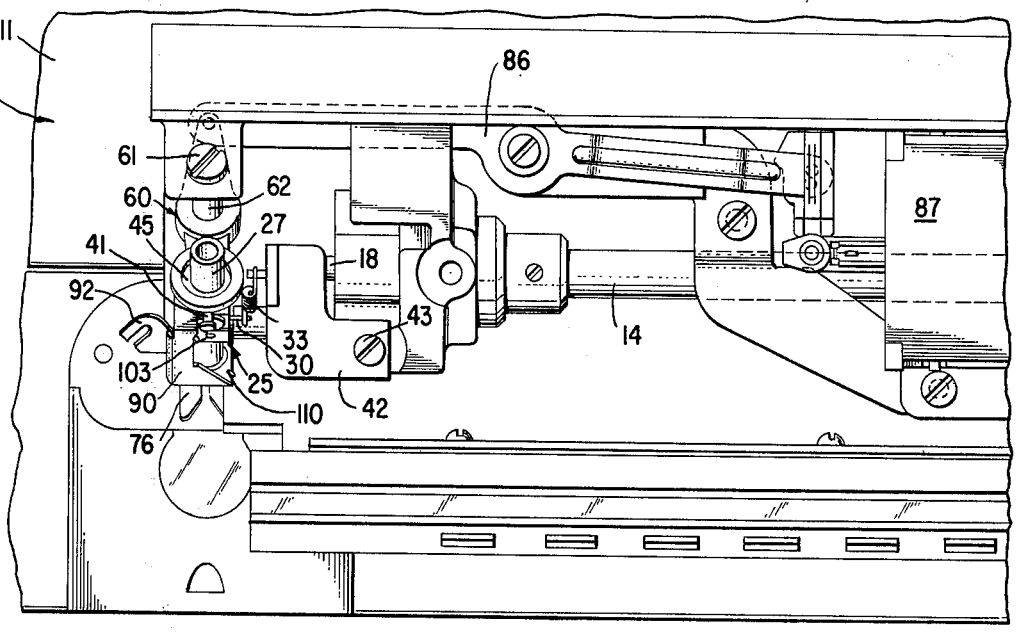

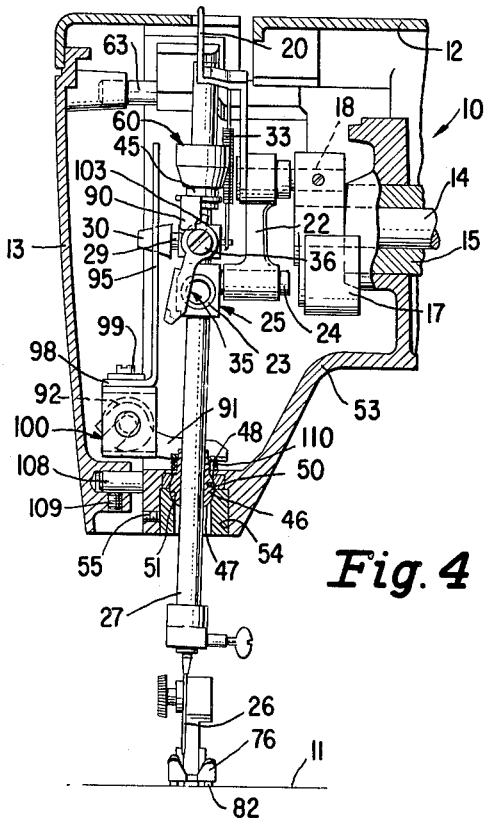
Fig. 4
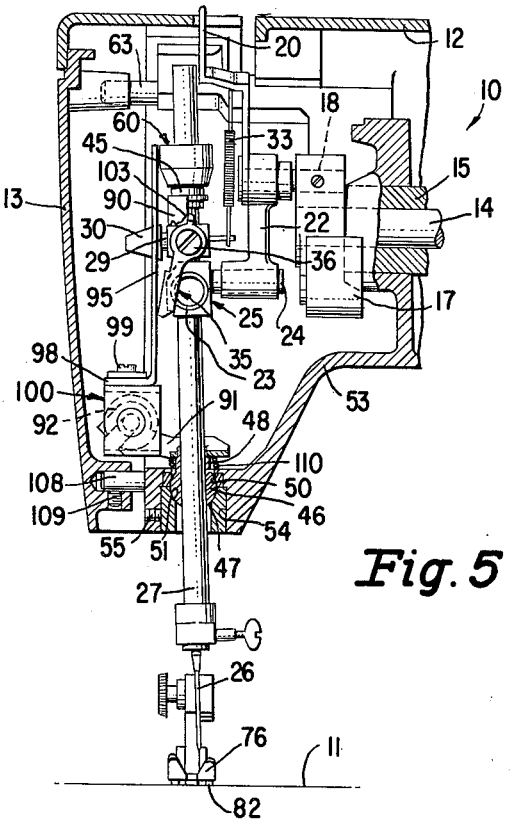
Fig. 5
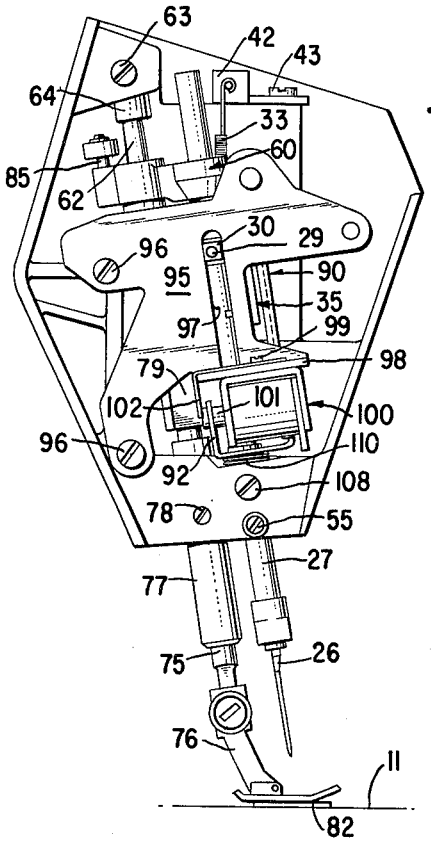
Fig. 6
Fig. 7
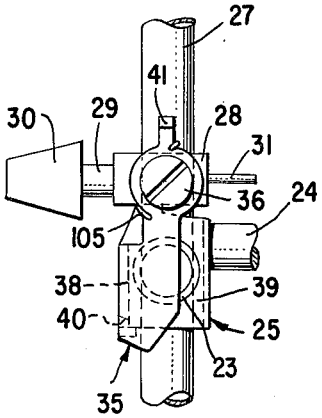

SKIP STITCH MECHANISM FOR SEWING MACHINES

BACKGROUND OF THE INVENTION

This invention relates to a skip mechanism for a sewing machine, more particularly to a skip stitch mechanism for a sewing machine which may be actuated automatically at any lateral position of the sewing needle.

There are in the prior art sewing machines wherein a stitch may be skipped upon lateral jogging of a needle bar beyond the range within which stitches may be formed. Such a device is disclosed in the U.S. Pat. No. 3,559,601, Feb. 2, 1971 of Tullman. It is also known in the prior art to construct a device wherein the needle bar gate may at will be elevated by manual means. In the U.S. Pat. No. 3,815,529, June 11, 1974 of Adams et. al., is shown a needle bar and gate module with such a device wherein by manually elevating a latch release member, a lever carried by a latch mechanism supported on a needle bar gate may be rotated at any lateral position to trip the latch mechanism.

With the advent of the electronically controlled sewing machine, however, there was a need for a device which would automatically skip a stitch at any lateral position without resorting to manual means. For example, when selecting a pattern for pattern stitching, the skip stitch mechanism may be actuated to prevent the placement of a wrong stitch prior to placement of the first stitch of the selected pattern. The U.S. Pat. No. 3,872,809, Mar. 25, 1975 of Adams et. al., discloses a needle bar and gate module similar to that disclosed in the U.S. Pat. No. 3,815,529 previously mentioned, but includes a solenoid actuating means to separate the needle bar from its drive means which may be energized at will to effect skipped stitches.

The above device, though effective, is characterized by a multiplicity of parts between the solenoid and the latch connecting the needle bar to its endwise reciprocatary drive mechanism, with resulting increase in manufacturing and assembly cost. The modular construction of the needle bar and gate, while useful and effective for certain purposes, also requires additional expensive frame components whose function may be included as part of the sewing machine frame.

What is required is a solenoid actuated skip stitch mechanism, with a bare minimum of parts between the solenoid and the needle bar carried latch, which will be effective at any lateral position of the needle bar; and which is achieved in an inexpensive needle bar-gate arrangement deriving its support from the sewing machine frame.

SUMMARY OF THE INVENTION

The above requirements are achieved in a sewing machine wherein the needle bar reciprocates within a lower bearing approximately intermediate the needle bar, the lower bearing having an outer ball surface received in a split spherical socket bearing supported in the sewing machine frame. The upper end of the needle bar is similarly supported for endwise reciprocation in a bearing having an outer ball surface received in a split spherical socket bearing supported in one end of a lever needle bar-gate pivoted on a stud fastened to the sewing machine frame. The upper and lower needle bar bearings are each fashioned with right cylindrical outer surfaces extending towards each other and adapted to support thereon for lateral movement with the needle bar an unlatching frame. The unlatching frame has an edge designed to cooperate with a needle bar carried latch mechanism at its uppermost range of travel to disengage the needle bar from its driving means when the unlatching frame is rotated relative to the needle bar. A bracket affixed to the sewing machine frame supports a solenoid adjacent the needle bar lower bearing in a position where a fork extension of the unlatching frame may be connected to the solenoid plunger. Thus when the solenoid is put into the active state, the unlatching frame may be rotated relative to the needle bar to disengage the needle bar from its driving means at its uppermost position.

DESCRIPTION OF THE DRAWINGS

The invention comprises the devices, combinations and arrangement of parts hereinafter described and illustrated in the accompanying drawings of a preferred embodiment in which:

FIG. 1 is a front elevational view of a sectioned sewing head portion of a sewing machine having the needle bar reciprocation interrupting means of this invention applied thereto;

FIG. 2 is a side elevational view of the sewing head portion with parts removed to show the details of the needle bar-gate arrangement, latch mechanism and unlatcching frame support;

FIG. 3 is a top plan view of a portion of the sewing machine as depicted in FIG. 2 to show the lateral jogging means for the needle bar-gate;

FIG. 4 is a front elevational view of the sewing head similar to FIG. 1 but with a part of the unlatching frame removed to show separation of the needle bar from its driving mechanism in maximum left needle position;

FIG. 5 is a front elevational view similar to FIG. 4 but showing separation of the needle bar from its driving mechanism in maximum right needle position;

FIG. 6 is a side elevation similar to FIG. 2 but with the solenoid and supporting bracket included; and, FIG. 7 is a front elevation of the needle bar and latch arrangement.

There is shown in FIG. 1 a section of the head end portion 10 of a sewing machine including a portion of the work supporting bed 11 and top cover 12 and a head end cover 13. Visible is a portion of an arm shaft 14 rotating in bearing 15 under the influence of a drive motor (not shown) supported elsewhere in the sewing machine frame. A crank 17 attached to the end of the armshaft 14 has affixed thereto a pin 18 offset from the armshaft centerline which connects take-up lever 20 and connecting link 22 to the crank to be oscillated thereby. The opposite end of the connecting link 22 is connected to the stud 24 of a drive link 25 supporting a collar 23 freely slidable on a needle bar 27.

Referring to FIG. 7 there is shown in greater detail the arrangement of the drive link 25 and collar 23 on the needle bar 27. A block 28 is firmly attached to the needle bar 27 by means of a screw 29 (see also FIG. 2) covered by a slab sided piece 30, whose purpose will be explained below. On the opposite side of the block 28 from the screw 29 a pin 31 is supported, protruding sufficiently to catch a hook end of an extension spring 33 (see FIGS. 1, 4 and 5). On the forwardly disposed face of the block 28, a latch 35 pivots on a shouldered screw 36. The latch 35 is fashioned with a rearwardly directed latch finger 38 (see FIG. 2) which extends beneath the front cheek piece 39 of the drive link 25 in a notch 40 in the lower corner of the cheek piece, thereby clasping the drive link to the block 28 affixed to the needle bar 27. The upper end of the latch 35 is formed with a forwardly directed ear 41 (see also FIG. 2) whose purpose will be explained below. A second hook end of the extension spring 33 is retained on a finger of a support 42 attached to the sewing machine frame 53 by screw 43 (see FIG. 3), thereby to retain the needle bar 27 in an elevated position when the latch 35 is disengaged from the drive link 25. A restoring spring 105 supported on shouldered screw 30 behind the latch 35, tends to rotate the latch in a counterclockwise direction as seen in FIG. 7 and into engagement with the drive link 25.

The needle bar 27 is supported for endwise reciprocation in an upper bearing 45 and lower bearing 46 which are substantially similar. The lower bearing 46, shown in cross section in FIGS. 1, 4 and 5, is formed with a ball outer surface 47 which is received in split upper and lower socket bearings 50, 51, respectively, inserted into the sewing machine frame 53 against shoulders in the opening 54 therein, and there retained by screw 55. The lower bearing 46 is further formed with a right cylindrical extension 48 projecting upwardly from the ball outer surface 47, more clearly apparent in FIGS. 4 and 5.

In FIG. 2 the upper bearing 45 is shown supported in a gate 60 with its right cylindrical extension 48 projecting downwardly. The ball outer surface 47 of the upper bearing 45 is supported in the gate 60 in substantially the same manner as the lower bearing 46 is supported in the sewing machine frame 53. The gate 60 pivots on a pivot post 62 affixed in a hole in the sewing machine frame 53 by screw 63. A collar 66 clamped to the pivot post 62 by screw 67 supports the gate 60 on the pivot post. The portion of the pivot post 62 within the hole in the sewing machine frame 53 is fashioned with an eccentric 64, eccentric with respect to the post so that by rotation of the screw head 61 (see FIG. 3) the inclination of the needle bar 27 may be adjusted for cooperation with a circular hook 70 (see FIG. 1) supported on a vertical axis for rotation in the bed 11 of the sewing machine under the influence of bevel gears 71 and hook drive shaft 72, connected to the main drive means of the sewing machine in a manner well known in the prior art.

Also visible in FIG. 2 is a presser bar 75, terminating in a presser foot 76, which is supported in a bushing 77 fixed in a bore in the sewing machine frame 53 by set screw 78. A guide block 79, affixed to the presser bar 75 by screw 80, is formed with a fin 81 extending through a slot (not shown) in the sewing machine frame 53 to retain the proper orientation of the presser foot 76 with the work feed dog 82. A pin 85 affixed to the end of the needle bar gate 60 opposite that within which the needle bar 27 is supported for endwise reciprocation may be connected by a driving arm 86 (see also FIG. 3) to a linear motor 87 supported in the sewing machine frame 53, thereby to effect lateral oscillation of the needle bar under the influence of an electronic control arrangement (not shown).

Thus far has been explained a neelde bar-gate arrangement substantially built into a sewing machine frame and having a needle bar carried latch mechanism for connection to an endwise reciprocating drive means. The needle bar 27 undergoes endwise reciprocation within an upper and lower bearing 45, 46 having outer ball surfaces 47 accommodated in split sockets 50, 51 permitting angular motion resulting from lateral oscillation of the needle bar under the influence of the linear motor 87. The portion of the needle bar 27 above the lower bearing 46 traverses a forwardly convex arc of a cone having its point at the center of the lower ball 47 and socket 50, 51 joint structure. That portion of the needle bar 27 below the lower bearing 46 traverses a forwardly concave arc of a cone having its point also at the center of the lower ball 47 and socket 50, 51 joint structure. In the lateral oscillation of the needle bar 27, the latch 35 connecting the needle bar to the drive link 25, moves with the needle bar. In order to permit unlatching of the needle bar 27 from the drive link 25 at any lateral position of the needle bar there is provided an unlatching frame 90, supported on the right cylindrical extensions 48 of the upper and lower bearings 45, 46, thereby to move with the needle bar in its lateral oscillation. The unlatching frame 90 is fashioned with a lateral ear 91, extending substantially parallel to a plane including the needle bar 27 at both extremes of lateral oscillation and terminating in a fork 92 closely adjacent the oscillating lower bearing 46.

A sheet metal bracket 95 is affixed to the sewing machine frame 53 by screws 96 and is fashioned with a slot 97 to accommodate the slab sided piece 30 covering the screw 29 affixing block 28 to the needle bar 27 (see FIG. 6). The piece 30 as restrained by the slot 97 maintains the needle bar 27 and the needle 26 affixed thereto in the proper orientation even though disconnected from the drive link 25. The bracket 95 is further formed with a laterally extending ear 98, to which affixed by screw 99 a solenoid 100. The solenoid plunger 101 is grooved to accept the fork 92 on the lateral ear 91 of the unlatching frame 90. Thus as the solenoid 100 is activated, the fork 92 of the unlatching frame 90 is drawn towards the solenoid 100 (see FIG. 6) rotating the unlatching frame about the right cylindrical extensions 48 of the upper and lower bearings 45, 46. An unlatching surface 103 of the unlatching frame 90 is thereby brought into a position where it will engage with forwardly directed ear 41 of the latch 35 when the needle bar is elevated to its upper extreme of travel. The unlatching surface 103 is fashioned to effect a relatively gradual rotation of the latch 35 about the shouldered screw 36 to accommodate, in conjunction with unlatching at low velocity of the needle bars 27 at close to top dead center of needle stroke, as noise and shock free needle bar unlatching as possible.

In FIGS. 4 and 5 are shown the position of the various components at the moment of unlatching for maximum left needle position and maximum right needle position, respectively. The unlatching frame 90 is shown partially in section to show more clearly the position of the various components. Since the unlatching frame is supported on the same upper and lower bearings 45, 46 within which the needle bar reciprocates and undergoes lateral oscillation it will maintain the same position with respect to the needle bar, regardless of the lateral location of the needle bar. Rotation of the unlatching frame 90 about the upper and lower bearings 45, 46 by activation of the solenoid 100 will, as explained above, bring unlatching surface 103 on the unlatching frame into a position to engage the forwardly directed ear 41 of the latch 35 to disengage the latch finger 38 from the drive link 25. The needle bar 27 will be retained in an elevated position by extension spring 33 for as long as the solenoid remains in an active state. When the solenoid is deenergized, the unlatching frame 90 will be returned to an inactive position under the influence of a spiral restoring spring 110 (see FIG. 2) supported on the cylindrical extension 48 of lower bearing 46 and biased between the sewing machine frame 53 and unlatching frame, tending to turn the unlatching frame in a clockwise direction as viewed in FIG. 3. A sheet metal stop 102, affixed to the laterally extending ear 98 of the bracket 95 by the screw 99, limits travel of the solenoid plunger 101 out of the solenoid 100 (see FIG. 6).

By inspection of FIGS. 4 and 5 it may be noted that by locating the fork 92 on the lateral ear 91 of the unlatching frame 90 closely adjacent the oscillating lower bearing 46 the effect of the needle bar 27 lateral oscillation on the connection of the unlatching frame to the solenoid 100 has been minimized and is readily accommodated by the fork 92. The aforementioned connection, taken in conjunction with the support of the unlatching frame 90 in a fashion to move with the needle bar 27 in its lateral oscillation, insures that the unlatching frame will maintain its position relative to the needle bar latch mechanism, whether in the inactive position or in the unlatching position.

Not shown in FIG. 6 for clarity are the presser bar presser regulating mechanism and lifting mechanism. The head end cover is supported on screws 63, 108 attached to the sewing machine frame 53, and may be locked in position by set screw 109 (see FIGS. 1, 4 and 9):

Thus has been disclosed an embodiment of a skip stitch mechanism, having a single unlatching frame 90 between the solenoid 100 and the needle bar carried latch 35, which is effective at any lateral position of the needle bar 27 achieved by a needle bar-gate arrangement incorproated insofar as possible as part of the sewing machine frame 53. The design of the skip stitch mechanism has been further refined to effect disengagment of the needle bar 27 from its drive link at a point where the kinetic energy in the moving mass is close to zero, thereby reducing the noise and shock of disengagement.

Having thus set forth the nature of the invention what we seek to claim is:

1. A skip stitch mechanism in a sewing machine having a frame, a needle bar, means supporting said needle bar for endwise reciprocation in said frame, a latch mechanism carried on said needle bar, actuating means for imparting forces through said latch mechanism for reciprocating said needle bar endwise, unlatching means supported by said means supporting said needle bar and selectively movable about said supporting means to a first position into cooperative relation with said latch mechanism to disconnect said needle bar from said means for imparting endwise reciprocation to said needle bar and to a second position out of cooperative relation with said latch mechanism, and actuating means for moving said unlatching means selectively to said first and second positions.

2. A skip stitch mechanism in a sewing machine having a frame, a needle bar, means supporting said needle bar for endwise reciprocation and for lateral oscillation in said frame, a latch mechanism carried on said needle bar, actuating means for imparting endwise reciprocation to said needle bar through said latch mechanism, unlatching means supported by said means supporting said needle bar for endwise reciprocation for lateral oscillation with said needle bar, said unlatching means being movable about said supporting means in any position of lateral oscillation of said needle bar selectively to a first position into cooperative relation with said latch mechanism to disconnect said needle bar from said means for imparting endwise reciprocation to said needle bar and to a second position out of cooperative relationship with said latch mechanism, and actuating means for moving said unlatching means selectively to said first and second positions.

3. A skip stitch mechanism as claimed in claim 2 wherein said unlatching means in said first position cooperates with said latch mechanism supported on said needle bar to disconnect said needle bar from said means imparting endwise reciprocation when said needle bar is substantially at one end of said endwise reciprocation.

4. A skip stitch mechanism as claimed in claim 3 wherein said actuating means includes a drive link freely slidable on said needle bar; wherein said latch mechanism includes a latch having engaging means thereon and having a pivot relative to said needle bar for rotation from an inclination where said engaging means is in engagement with said drive link to effect endwise reciprocation of said needle bar to an inclination where said engaging means is out of engagement with said drive link, said latch further including a lug spaced from said pivot; and, wherein said unlatching means includes a camming surface for engagement in said first position of said unlatching means with said lug of said latch substantially at one end of said needle bar endwise reciprocation for displacing said lug and rotating said latch and engaging means thereon out of engagement with said drive link.

5. A skip stitch mechanism as claimed in claim 4 wherein said camming surface of said unlatching means in said first position engages with said lug of said latch substantially at the uppermost end of said needle bar endwise reciprocation.

6. A skip mechanism as claimed in claim 2 wherein said means supporting said needle bar for endwise reciprocation and lateral oscillation includes a bearing means supported in a ball and socket arrangment in said sewing machine frame intermediate said needle bar, and wherein said actuating means is supported by said sewing machine frame for connection to said unlatching means adjacent said ball and socket arrangement.

7. A skip stitch mechanism as claimed in claim 6 wherein said unlatching means if fashioned with an ear substantially parallel to a plane including the axis of said needle bar at the extremes of lateral oscillation, said ear terminating in a bifurcation extending in a direction perpendicular to a radial extension of said ball and socket arrangement; and wherein said actuating means comprises a solenoid coil disposed to operate substantially normal to said plane, said coil having a plunger, said plunger having a circumferential groove situated externally of said coil, said bifurcation of said unlatching means being engaged with said circumferential groove.

* * * * *

UNITED STATES PATENT OFFICE

CERTIFICATE OF CORRECTION

PATENT NO. : 4,000,706

DATED : January 4, 1977

INVENTOR(S) : Ernst Kreissel, Erwin Vahle, Hans Uhlig

It is certified that error appears in the above-identified patent and that said Letters Patent are hereby corrected as shown below:

Column 1, line 23 after "lateral" insert -- needle --

Column 1, line 52 after "support" insert -- directly --

Column 2, line 28 "unlatcching" should read -- unlatching --

Column 6, line 42 after"skip" insert -- stitch --

Signed and Sealed this

Fifth Day of April 1977

[SEAL]

*Attest:*

RUTH C. MASON
*Attesting Officer*

C. MARSHALL DANN
*Commissioner of Patents and Trademarks*